US008858108B2

(12) United States Patent
Taverner

(10) Patent No.: US 8,858,108 B2
(45) Date of Patent: Oct. 14, 2014

(54) KEYPAD SHIELD

(75) Inventor: Alistair Taverner, Essex (GB)

(73) Assignee: Alistair Taverner, Essex (GB)

( * ) Notice: Subject to any disclaimer, the term of this patent is extended or adjusted under 35 U.S.C. 154(b) by 313 days.

(21) Appl. No.: 13/513,984

(22) PCT Filed: Dec. 7, 2010

(86) PCT No.: PCT/GB2010/052043

§ 371 (c)(1),
(2), (4) Date: Aug. 9, 2012

(87) PCT Pub. No.: WO2011/070355

PCT Pub. Date: Jun. 16, 2011

(65) Prior Publication Data

US 2012/0328350 A1 Dec. 27, 2012

(30) Foreign Application Priority Data

Dec. 8, 2009 (GB) ..... 0921475.0

(51) Int. Cl.
*G07D 9/00* (2006.01)
*G07F 19/00* (2006.01)
*G07F 7/10* (2006.01)

(52) U.S. Cl.
CPC ..... *G07F 19/201* (2013.01); *G07F 19/205* (2013.01); *G07F 19/2055* (2013.01); *G07F 19/20* (2013.01); *G07F 7/10* (2013.01)
USPC ..... 400/714; 359/610; 359/613

(58) Field of Classification Search
CPC ..... H01H 2223/044; G07F 19/2055; G07F 19/205
USPC ..... 400/714; 200/304; 379/447; 359/610, 359/613, 601, 603, 608; 109/10
See application file for complete search history.

(56) References Cited

U.S. PATENT DOCUMENTS 6,144,319 A * 11/2000 Lutz et al. ..... 341/22
7,337,955 B1 3/2008 Block et al.
2013/0279011 A1* 10/2013 Kubota ..... 359/613

FOREIGN PATENT DOCUMENTS

DE 4406115 8/1995
DE 29800830 3/1998

(Continued)

OTHER PUBLICATIONS

RD 308059, High security PIN keyboard to preserve customer privacy assigns characters to keys randomly which are visible to user only, anonymous, Dec. 1989.*

(Continued)

*Primary Examiner* — Daniel J Colilla
(74) *Attorney, Agent, or Firm* — Andrus Intellectual Property Law, LLP

(57) ABSTRACT

A shield for overlying a keypad such as a PIN pad. The shield 10 permits manual access to the pad 24 and comprised a screen 30 having a transverse direction and a longitudinal direction and formed from a transparent material through which in use the keypad is viewable by a user of the keypad only from within a limited angular range. The screen has an upper side 44 directed in use generally toward a user and a lower side 41 directed in use generally toward the keypad, the screen further having an upper series of transversely extending parallel opaque strips 45 and transparent gaps, and a similar lower series of strips 40 and gaps, which lower series is offset from the upper series so that, when viewed from above, the opaque strips of the upper and lower series overlap and block the view.

7 Claims, 5 Drawing Sheets

(56) References Cited

FOREIGN PATENT DOCUMENTS

| | | | | |
|---|---|---|---|---|
| EP | 92048 | A | * | 10/1983 |
| FR | 2861484 | | | 4/2005 |
| FR | 2861484 | A3 | * | 4/2005 |
| GB | 2421345 | | | 6/2006 |
| GB | 2422353 | | | 7/2006 |
| GB | 2452722 | | | 3/2009 |
| JP | 2003203265 | A | * | 7/2003 |
| JP | 2007065987 | A | * | 3/2007 |
| JP | 2012014547 | A | * | 1/2012 |
| WO | 9624942 | | | 8/1996 |
| WO | 2006/120479 | | | 11/2006 |

OTHER PUBLICATIONS

International Search Report dated Mar. 2, 2011 in PCT Application No. PCT/GB2010/052043.

* cited by examiner

KEYPAD SHIELD

CROSS-REFERENCE TO RELATED APPLICATIONS

This application is the U.S. national stage application of International Application PCT/GB2010/052043, filed Dec. 7, 2010, which international application was published on Jun. 16, 2011, as International Publication WO 2011/070355 in the English language. The International Application claims priority of UK Patent Application 0921475.0, filed Dec. 8, 2009.

This invention relates to a shield mountable on or around a keypad, and in particular a shield that restricts the view of those other than the person using the keypad.

PINs (personal identification numbers) and other alphanumeric codes are required in every day life to verify that a person using a bank card to withdraw cash from an ATM or pay for goods electronically using the so-called 'chip and pin' machines or PEDs (PIN Entry Devices), is authorised to do so. If the person in possession of the card is unaware of the corresponding PIN, the card will not be accepted to withdraw money or pay for goods electronically. Stolen bank cards have always been a common form of fraud, particularly when the only required form of authorisation was a signature, which is easily forged. Now such verification methods are being phased out, criminals now need to ascertain the PIN before stealing or copying/cloning the bank card. This may be carried out by placing a small camera in a discreet location in or around an ATM, and recording all use of the keypad, which inevitably captures footage of the PIN being entered. It may also be achieved by a bystander watching and memorising the entry of the PIN—often known as shoulder surfing. Then all the observer has to do is steal or clone the card and use the observed PIN. The problem of viewing by bystanders is particularly acute with the design of most chip and pin units which provide limited if any shielding from onlookers, who are usually arranged all around.

Previous attempts have been made to address this problem including the applicant's own earlier International application WO2006/120479. Whilst that provided an improvement on earlier attempts, the results still left room for improvement in certain circumstances particularly hidden cameras above a keypad.

It is therefore a principle aim of the present invention to provide an improved shield mountable on or around new or existing keypads, to prevent onlookers from viewing the entry of a secret PIN, password or code. Whilst most current use is envisaged for ATMs and point of sale PEDs, the present invention provides a device suitable for any keypad where secret codes are entered.

According to the present invention, there is provided a shield for overlying a keypad while permitting manual access thereto, the shield comprising a screen having a transverse direction and a longitudinal direction and formed from a transparent material through which in use the keypad is viewable by a user of the keypad only from within a limited angular range, the screen having an upper side directed in use toward a user and a lower side directed in use toward the keypad, the screen further having an upper series of transversely extending parallel opaque strips and transparent gaps, and a similar lower series of strips and gaps, which lower series is offset from the upper series so that, when viewed directly from above, the opaque strips of the upper and lower series overlap and block the view (non-transmissive).

The phrase "opaque" is intended to mean substantially non-transmissive of light. This in turn means is intended to mean that no light passes through or is transmitted by the opaque strips or that the amount of light passing through the strips is low enough (or scattered/disrupted/blocked enough) to prevent a user or camera from seeing therethrough to the keypad. Similarly as used below the term occluded implies total light obstruction or a level of light obstruction that is high enough to render it non-transparent. Overall the strips are required to be non-view-through at least within a range of view angles.

The strips are usually laser etched or screen printed (although other techniques can be used to produce them) onto a clear polycarbonate or acrylic screen to create opaque strips, with the transparent gaps created there between. The strips may be generally evenly pitched (but can also have regions of different pitch and gap width as well). A 1 mm thick screen (also referred to as a lens especially if part of a larger screen assembly) could have a 1 mm wide strip with a 1 mm wide gap (transparent strip). Preferably a screen might be 0.5 mm thick and could have a 0.4 mm wide strip with a 0.3 mm wide gap. Reducing the thickness of the screen from 1 mm to 0.5 mm and use of finer strips gives greater clarity. Also narrower screens can be over moulded into the device during manufacture.

The strips on the top and bottom are offset to make the required blocked and open viewing angles. For instance when blocking an anglar range that includes the angle perpendicular to the screen the opaque strips on the top face need to align with transparent gaps on the bottom face thus blocking the view. The blocked angular range needs often to include the angle perpendicular to the keypad, which may be in the same plane as the screen or may be slightly different.

The main body may include two opposing sidewalls spaced apart laterally, between the upper parts of which the screen extends. The distance between the opposing sidewalls is greater than the respective distance across the keypad so that a user's hand may fit there between to operate the keypad. These sidewalls will act to block the view from the side.

The main body can further include an upper wall or distal wall extending between the two sidewalls. The screen can be defined within the upper wall at a location overlying the keypad such that a user may view the keypad therethrough. In this arrangement the screen and main body are essentially fixed, although it is possible that the shield could be mounted in such away as to be repositioned as a whole. However, to facilitate use, possibly by those who are either unable or unwilling to make use of the advantages of the present invention, it is possible for the screen to be mounted in such away as to be moveable relative to the base so as selectively to cover and uncover the keypad or alter accessibility. One way of achieving a degree of movement is to pivotally-mount the screen along its back edge so that it can hinge or flex, for example using a flexible rubber flange or hinge. A suitable hinge may include a metal bracket with tapped pins that locate into sockets in the lens. The angular range of movement of such a screen can be limited or guided by suitable abutment formations on the base.

In another way to achieve this, the screen may be slidably located in guide members formed on each sidewall, so that the screen can be slid between a use position, whereat it overlies the keypad, and a retracted position, not overlying the keypad. This arrangement gives a user the option of viewing the keypad directly or through the screen. However one of the advantages that the present invention provides over the prior art is that the viewing angle is orientated in such a way with respect to the plane of the screen and keypad that the shield can be configured to be less manually restrictive, whilst still offering improved protection.

A portion of the main body, often a lower portion of each sidewall, is suitably configured to interface with the surface surrounding the keypad. Such an arrangement could include an integrally moulded flange extending outwardly from the lower edge of the main body and in a plane parallel to the surface with which it is to interface. The flange or flanges are suitably sized to facilitate secure fastening of the shield to the keypad, or the structure in which the keypad is mounted. Suitable means of fastening the shield to a keypad could include mechanical fasteners and/or adhesives. The shield could also be integrally formed with the keypad or the unit in which the keypad is located.

The main components, i.e. the screen and main body are preferably made from plastics material. The screen is preferably made from plastics material that is suitably transparent or clear. High oil based plastics may be used for many of the main components, as these are less prone to vandalism since chewing gum will not adhere to the surface and glues and inks will not set or dry.

The screen may be all or only part of a single member. For example this member may be a sheet of normally transparent material which might have a region provided with strips (or bearing a film with such strips) which serves as the screen through which the PED is viewed. Other areas of that sheet may be differently treated to confer different viewing characteristics.

The strips are preferably formed on a sheet of transparent material by suitable methods such as screen printing. It is advantageous that the strips are resistant to tampering so as to resist their removal by criminals seeking to degrade the protection they afforded be reducing the masking effect of the screen. Such strips may be screen printed in black, as black absorbs more light and so reduces light scatter within the material of the screen which can make it too hazy.

Parts of the main body and screen may be formed from a flexible or resiliently deformable rubber. This may be in the form of an overmould connected to other parts. Such resilient parts can be use to prevent sharp edges being exposed and to stop potential leverage by criminals. The rubber resilient parts may be made from a TPU or Alcryn™ which gives a good bond to the rigid polycarbonate and also confers a degree of fire retardancy. Standard TPE (thermoplastic elastomer) which is can be used in this situation is not fire retardant According to the present invention there is also provided a device incorporating a keypad and as well as a shield as described above.

In order that it may be better understood, but by way of example only various embodiments of the present invention with now be described in detail with reference to the accompanying drawings in which.

Figure 1:
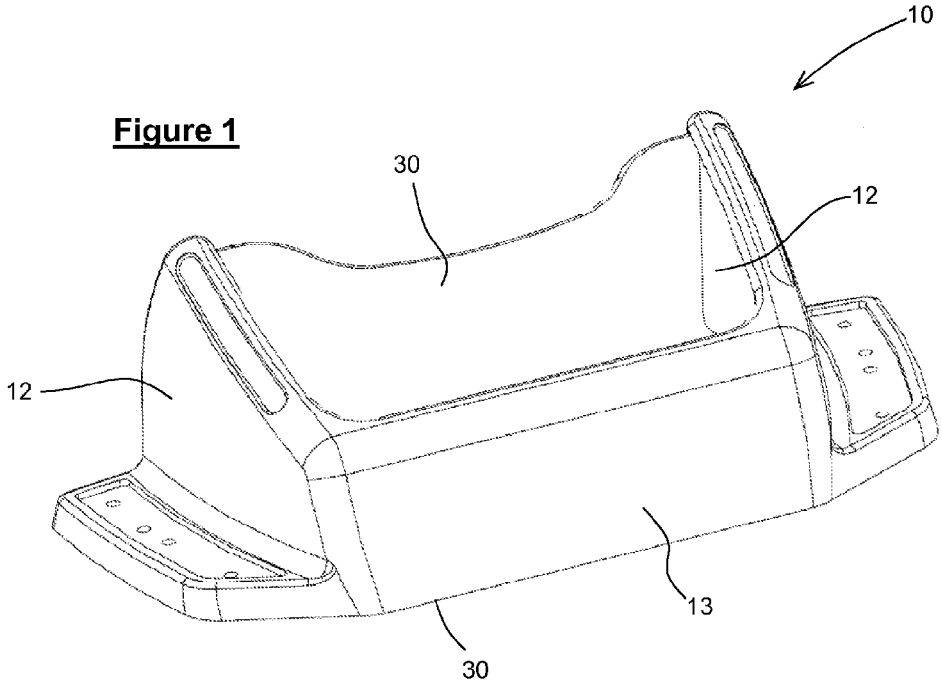
FIG. 1 is a perspective view of a first embodiment of shield of the present invention.
Figure 2:
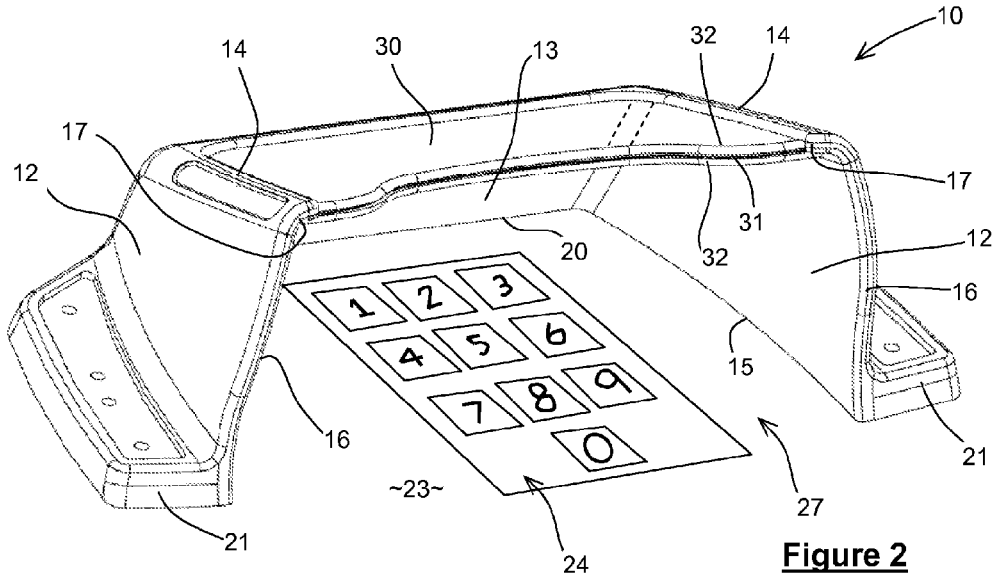
FIG. 2 is a perspective view of the same embodiment, but from the other side and shown mounted over a keypad.
Figure 3:
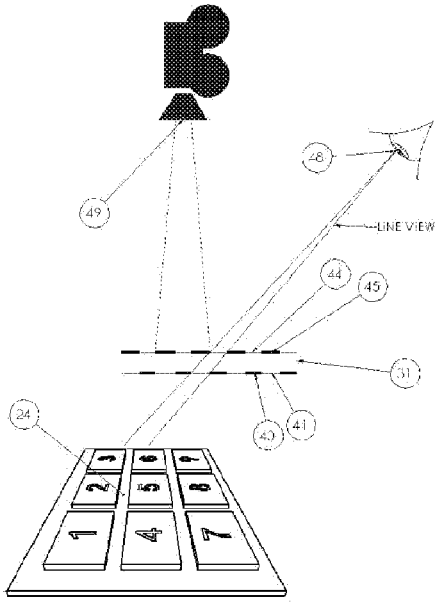
FIG. 3 is an enlarged diagrammatic view of the screen in that shield showing the optical performance.

Referring to FIGS. 1 to 3, the shield (generally indicated 10) comprises an integrally moulded main body having two opposing sidewalls 12 and a distal wall 13 extending therebetween. Each sidewall 12 includes an upper edge 14 and a base edge 15 and a second edge 16 that meet at approximately 90°. Each base edge 15 is parallel to the plane of the surface to which the shield 10 is to be mounted, and each second edge 16 extends substantially upwardly and faces generally toward the operator of the keypad. An in-turned lip 17 is defined along the upper edges 14 of each sidewall. The distal wall 13 joins each sidewall and extends only partially up the upper edges of the sidewalls. A screen 30 extends laterally between the lips 17 of the side walls and forward to an upper edge of the distal wall.

The distal wall and sidewalls, including the lips are formed from sufficiently opaque material, through which the view of the keypad is obscured. Spark/bead blast finished plastics material is suitable. In this embodiment the main body comprising the sidewalls and distal wall are made from polycarbonate plastic, which is then spark finished/bead blasted. The spark finish provides a course texture which obscures view, preventing the keypad operator's PIN from being seen or recorded through these components, while having a degree of translucency. A translucent main body makes it harder to conceal cameras or other illegal prying devices inside the shield to secretly record entry of the PIN are easily noticed. Further, the material is highly lubricious to prevent adhesive and chewing gum from sticking to the surface. The body may also be formed from a wholly opaque material.

The bottom edge 20 of the distal wall 13 is coplanar with the base edges 15 of the sidewalls 12. These together provide a stable U-shaped base to support the shield. A flange 21 is provided at the bottom of each sidewall and extends perpendicular and outward therefrom. The main body can be adhered to a surface 23 surrounding a keypad 24 (as shown in FIG. 2), for example by applying double-sided tape (not shown) to the underside of each flange 21. 3M produce a suitable VHB (very high bond) tape made from conformable acrylic foam. If screws, bolts or other like mechanical fixings are used to hold the main body in place, the heads of these may be covered by security stickers so that tampering with them becomes more evident.

The screen 30 can have a hardened, anti scratch surface with a water spray and glue repellent surface.

The screen 30 is disposed over the keypad 24 to obscure the keys when viewed within a particular range, and to appear sufficiently transparent when viewed from outside that range thereby to allow operation of the keys with significantly reduced risk of unauthorised observation of the key strokes. In effect it achieves this by blocking the view within a particular angular range and allowing view outside that range.

The screen 30 is a transparent lens that extends between the side walls 12 and the distal wall 13 in this embodiment comprises a series of opaque strips 45 and 40 and clear strips 44 and 41. In an alternative embodiment the screen may be moulded into the main body.

The screening layer 31 (or lens) is formed from a transparent material, has a planar upper side 44 and has a lower side 41 on which are a series of opaque non reflective strips. The strips are spaced top and bottom and offset so that when viewed from directly above 53 the strips overlap and block the view.

A user's viewpoint is represented by the eye 48, although obviously it is neither to scale nor the correct distance, the relative direction is appropriate. The viewpoint 48 shows the view though the transparent strips. The blocked angle 49 shown as a camera, shows the view blocked as the opaque strips overlap and block the view In use, the main body is fastened or adhered to a surface 23 surrounding the keypad 24, such that the screen 30 is disposed thereover. The open rear end (indicated by arrow 27) permits manual access to the keypad. The keypad 24 is operated by a person extending their hand through the opening 27, so as to access the keys.

A shield like this could be slidably mounted as a whole around the keypad so that the keypad operator has the option of positioning it over the keypad or retracted from the keypad. The screen may be mounted to a rubber gasket as mentioned earlier to allow such movement. A slidably mounted version would require guide means on the under side of each flange for slidably mounting the shield to correspondingly arranged guide means on the surface surrounding the keypad.

Figure 4:
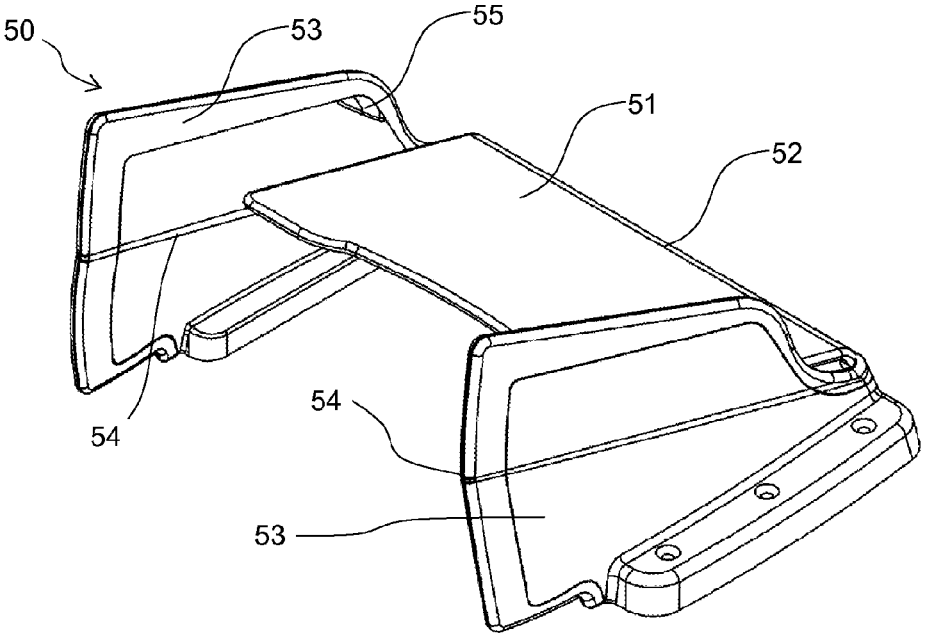
FIG. 4 is an isometric view of a second embodiment of shield according to the present invention.

FIG. 4 shows an alternative second embodiment of shield generally indicated 50. This has a screen 51 that operates optically in the same way as the screen 30 of the first embodiment as discussed above. The significant difference between this second embodiment and that described above is that the screen 51 is hingedly connected at a back edge 52 to the main body so that it may lie close to the keypad when not in use (to minimise obstruction of other components of the ATM/PED) but may be lifted up slightly by a user's hand to use the keypad.

Each side wall 53 of the main body diverges slightly in an upward direction thereby to define lower abutments 54 on the inwardly directed faces thereof. The screen 51 rests on these when not in use. To limit the upward range of hinging movement, upper abutments 55 (only one of which is visible) may also be provided higher up on the inwardly directed faces of the side walls 53. These prevent the screen from being moved so far up that it diminishes the optical shielding effect. The range of movement may be set according to needs, but in many cases a suitable range is about 20°.

The screen 51 may be hingedly connected by any suitable means known in the art. In this embodiment the screen 51 which is rigid is joined to the main body by a band of flexible material that resiliently deforms as the screen moves relative to the main body.

In use a user would place the tips of their fingers beneath the screen 51 and if necessary would lift the screen slightly to place their fingers thereunder. The screen might rest on the fingers in use, and the fingers and keypad would be visible through the screen within a limited range. When the hand was removed the screen would fall back to rest on the lower abutments 54.

Figure 5:
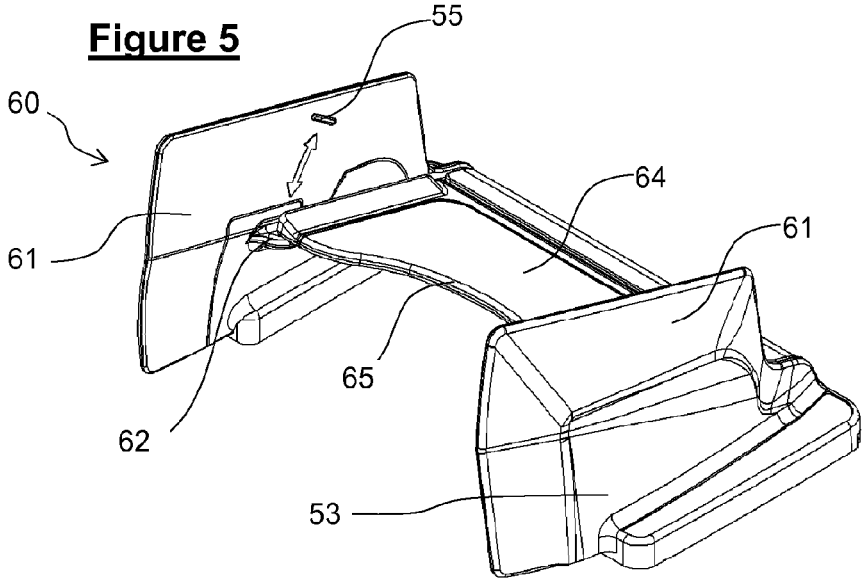
FIG. 5 is an isometric view of a similar third embodiment of shield according to the present invention.

FIG. 5 shows a third embodiment of shield 60 that is similar to the second embodiment and like reference numerals are used in respect of like parts. Apart from the shape of certain parts the third embodiment differs in the mechanism of hinging of the screen to the main body. Also the third embodiment 60 has rubber portions 61 around the upper and rear periphery of the side walls 53. The lower abutment 62 is larger. Parts of the main body and screen that are formed from a flexible or resiliently deformable rubber may be in the form of an overmould connected to other parts. Such resilient parts can prevent sharp edges being exposed and to stop potential leverage by criminals. These rubber parts are made from a thermoplastic polyurethane (TPU) or Alcryn™.

Figure 6:
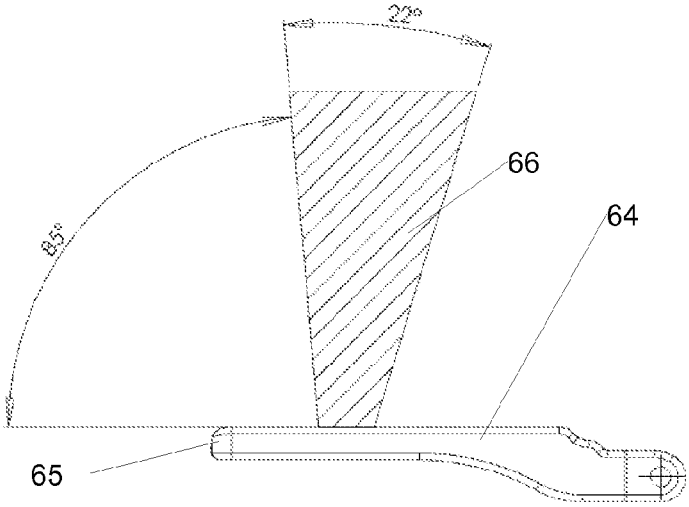
FIG. 6 is s cross section through the screen of the third embodiment showing the blocked viewing angle.
Figure 7:
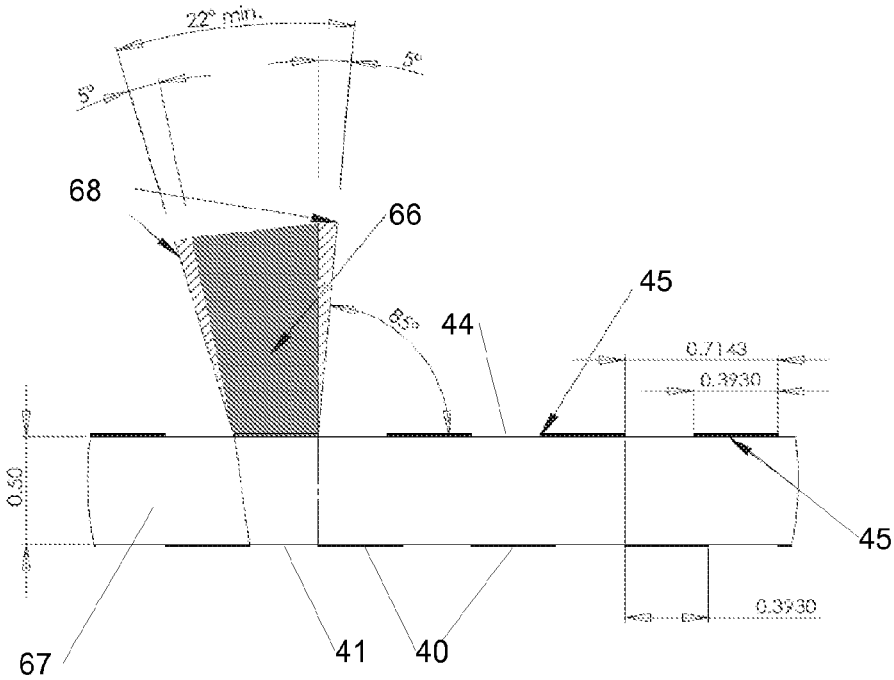
FIG. 7 is an enlarged diagrammatic view of the screen of FIG. 6 showing the optical performance.

The screen 64 is shown in cross section in FIG. 6 and the shaded angle 66 is the completely blocked viewing angle. To the sides of this are partially blocked viewing regions 68 each of about 5° which are blocked enough to prevent view. Together these equally approximately 22° and the region start approximately 85° from the plane of the free edge 65 of the screen. This screen is partly formed by a thin lens 67 carrying the screen printed strips (again numbered 40, 45) and resultant gaps and this is shown in an enlarged schematic view in FIG. 7. The distances shown are in mm. The top layer of strips 45 may be printed twice but the bottom strips may be printed only once.

One potential concern with an embodiment having a pivoting screen is that the criminals may simply prop the screen up so that their camera is brought into line with the viewing angle. To combat this, adjustment arrows and abutments can help to inform and encourage customers about the correct operation of the present invention. Also other references that the customer can see (such as diagrams on decals fitted beside the present invention, as well as pictures/animations shown on a separate screen of the cash machine) can further educate a customer about the proper use.

In addition to that customer education the screen may have an increased line thickness (and or reduced gap width) at the back region (ie the part nearest a hand and furthest from a hinge) of the screen. This could extend about 20 mm to 30 mm from the edge of the lens. This region will tend to move over the key pad when lifted and will still partially block the view of a camera even when the lens is propped up by over 20°. Along with this a warning sign can be provided on the underside of the screen. This can be formed such that it aligns with the stripes so does not block the view of user but is visible when the lens is lifted too high Manufacture of a screen suitable for use in the present invention is not straight forward as this must provide excellent viewing properties only within the required viewing angle as well as being resistant degradation and attack. Preferably the screen comprises a lens (although usually a planar one that does not necessarily focus light passing therethrough) that may be self supporting or in a screen assembly having clear carriers or covers for that lens. The lens has strips correctly aligned relative to each other on both sides. The strips are preferably screen printed in two-part screen print ink. Vinyl screen print was found to be too susceptible to thinners and was easily wiped off. Using a 2-part screen print ink at a ratio of 4-5 parts ink to 1 part activator/hardener (rather the 6-10 to 1) and then baking for 45 minutes at +80° C. made the strips stable enough to endure xylene thinners. Polycarbonate with its high melting point was particularly suitable as a material to form the lens as it could withstand the high temperatures. Also to achieve the required opacity in the strips the strips are printed twice per side.

Figure 8:
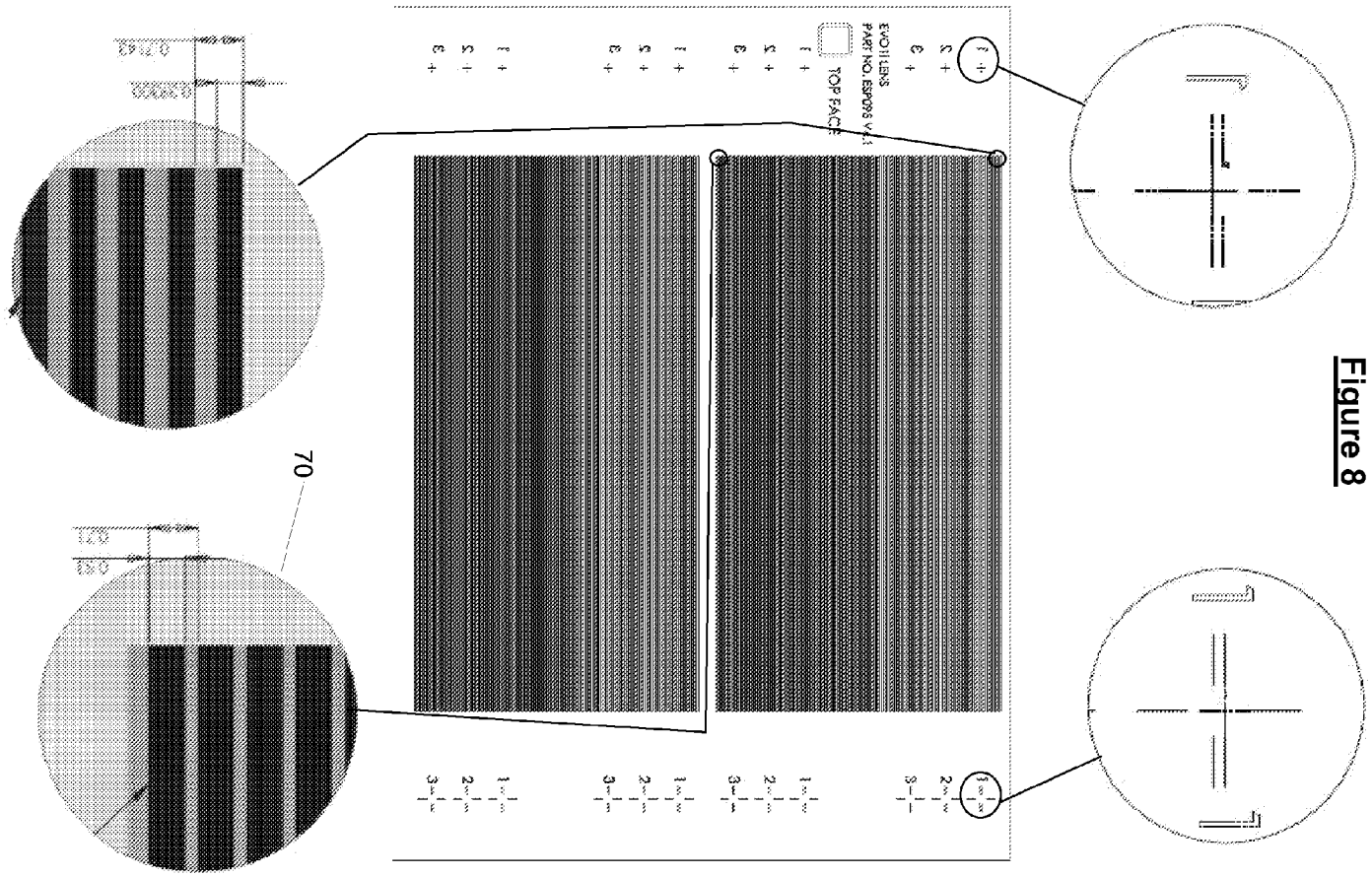
FIG. 8 is a view with enlarged details of a printing guide for a screen printing the stripes of a screen.

The accuracy of the offset between the strips on one side and those on the other is critical and may need to be accurate to within about 10 μm-50 μm. As part of the present invention a unique system has been developed to permit accurate screen printing of the strips. This method of aligning the top and bottom screens relies on the use of register marks, which are aligned on flipping of the sheet being printed during manufacture. The alignment can be achieved by aligning register marks in the form of crosshairs on the top side of the screen with those on the reverse prior to or during printing. The same printing screen must be used for both sides otherwise slight discrepancies between the printing screens ruins the offset tolerances. FIG. 8 shows a printing template for screen printing a polycarbonate sheet. There are two identical regions of lines from which multiple screens can be cut. The register marks are the numbered cross-hairs down the sides. Two of which are shown in enlarged details, but in the enlarged detail the image that appears is that of the cross from one side (left in this view) aligning within the cross from the other side (right in this view) when a sheet is flipped. The spacing of the strips in two different regions is shown in the lower details in FIG. 8. The narrower gaps in view 70 create a wider blocked non-viewing angle, so this region is more restrictive in view such that when a screen is partially lifted this region will still provide some obstruction to view.

A polarising lens may also be included in the screen. This may be achieved by over-moulding the polarising lens on the stripped concealing lens. This is done by holding the lens to the tool by a vacuum then moulding over the top of it. Static holding systems didn't work and over-moulding a 0.5 mm lens is very hard to achieve.

The invention claimed is:

1. A shield for overlying a keypad while permitting manual access thereto, the shield comprising a screen having a transverse direction and a longitudinal direction and formed from a transparent material through which in use the keypad is viewable by a user of the keypad only from within a limited angular range, the screen having an upper side directed in use toward a user and a lower side directed in use toward the keypad, the screen further having an upper series of transversely extending parallel opaque strips and transparent gaps, and a similar lower series of strips and gaps, which lower series is offset from the upper series so that, when viewed from above, the opaque strips of the upper and lower series overlap and block the view.

2. A shield as claimed in claim 1, wherein the strips are screen printed on the upper and lower side of the screen, or upper and lower sides of a lens forming part of the screen.

3. A shield as claimed in claim 1, wherein the screen is mounted in such a way as to be moveable relative to the base.

4. A shield as claimed in claim 3 wherein the range of movement is limited and such movement selectively covers and uncovers the keypad or alters accessibility.

5. A shield as claimed in claim 1, wherein the screen blocks view within a range of at least 22° in a longitudinal plane.

6. A shield as claimed in claim 2, wherein the screen in mounted in such a way as to be moveable relative to the base.

7. A device incorporating a keypad and a shield as claimed in claim 1.

* * * * *